United States Patent [19]

Turchi et al.

[11] Patent Number: 4,709,680

[45] Date of Patent: Dec. 1, 1987

[54] DEVICE FOR CONTROLLING FUEL INJECTION APPARATUS IN DIESEL ENGINES

[75] Inventors: Sergio Turchi, Rivalta; Renato Filippi, Nichelino, both of Italy

[73] Assignee: Weber S.p.A. Azienda Altecna, Turin, Italy

[21] Appl. No.: 877,074

[22] Filed: Jun. 23, 1986

[30] Foreign Application Priority Data

Jul. 2, 1985 [IT] Italy ..... 53563/85[U]

[51] Int. Cl.[4] ..... F61M 39/00

[52] U.S. Cl. ..... 123/467; 123/506; 137/538

[58] Field of Search ..... 123/506, 467, 447, 446; 417/490, 499, 307; 137/538

[56] References Cited

U.S. PATENT DOCUMENTS

| | | | |
|---|---|---|---|
| 4,467,767 | 8/1984 | Kampichler | 123/506 |
| 4,478,189 | 10/1984 | Fenne | 123/467 |
| 4,524,799 | 6/1985 | Fenne | 123/467 |
| 4,577,606 | 3/1986 | Bohringer | 123/506 |

FOREIGN PATENT DOCUMENTS

| | | | |
|---|---|---|---|
| 1289359 | 2/1969 | Fed. Rep. of Germany | 123/467 |
| 3424401 | 1/1986 | Fed. Rep. of Germany | 123/506 |
| 439002 | 9/1948 | Italy | 123/467 |
| 2131485 | 6/1984 | United Kingdom | 123/467 |

*Primary Examiner*—Carl Stuart Miller

*Attorney, Agent, or Firm*—Sughrue, Mion, Zinn, Macpeak & Seas

[57] ABSTRACT

Fuel injection apparatus for diesel engines includes an injection pump connected to an injector nozzle through a control device constituted by two calibrated and opposed non-return valves arranged to keep a residual pressure of a predetermined magnitude in the fuel supply passage to the injector between each injection cycle and the next. The two non-return valves are located downstream of the output of the pump and are preferably inserted in a body fixed to or forming part of the injector, or forming part of the delivery union of the pump.

5 Claims, 1 Drawing Figure

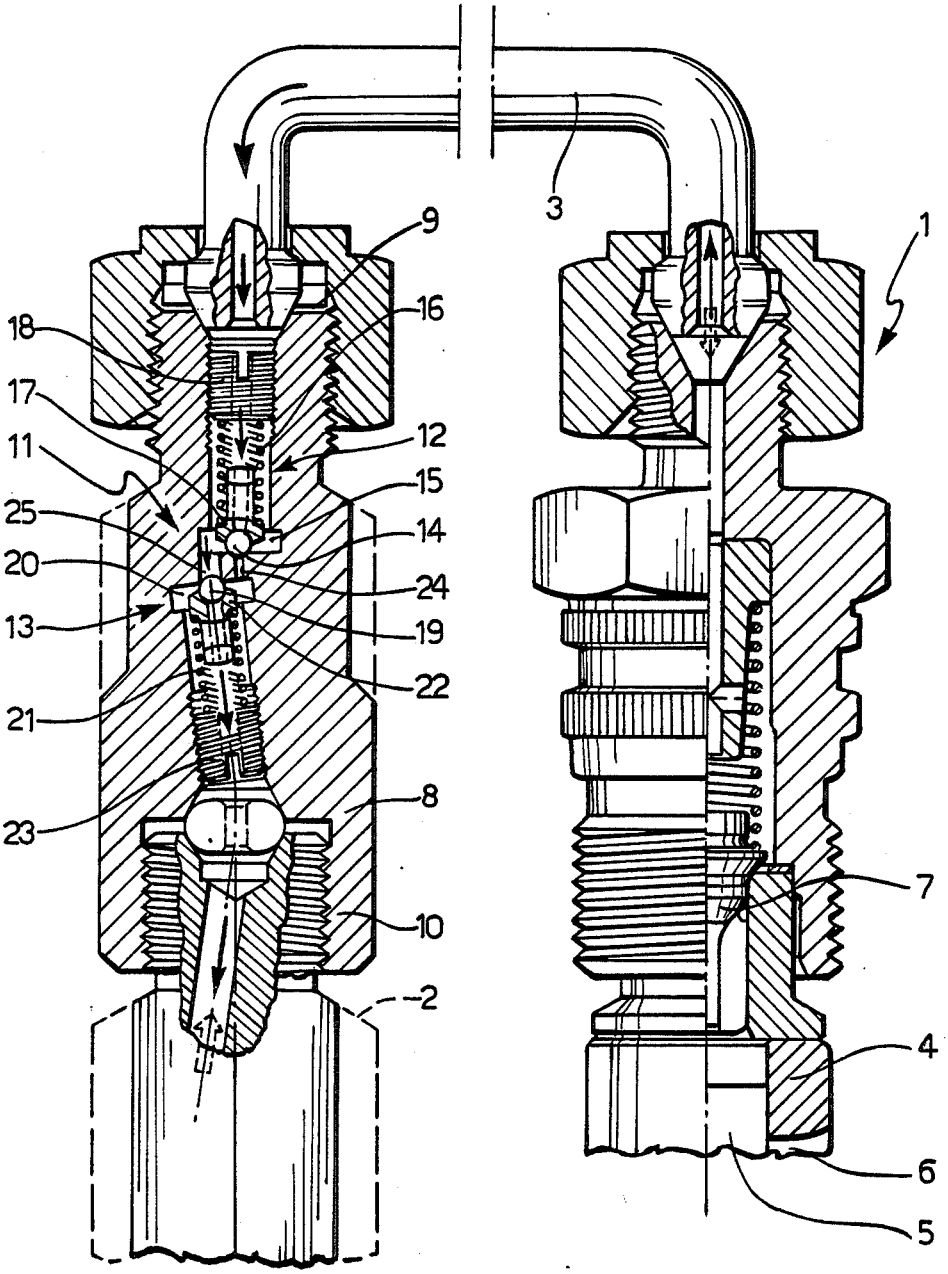
1
2
3
4
5
6
7
8
9
10
11
12
13
14
15
16
17
18
19
20
21
22
23
24
25

DEVICE FOR CONTROLLING FUEL INJECTION APPARATUS IN DIESEL ENGINES

The present invention relates to fuel injection apparatus for diesel engines, of the type including an injection pump connected to an injector nozzle through valve means arranged to maintain a residual pressure of a predetermined magnitude between the valve means and the injector nozzle between each injection cycle and the next.

In practice, the valve means ensure a certain pressure, herein termed "residual", at the end of each injection cycle, which must be kept practically the same independently of the running conditions/load on the engine and the introduction of the fuel. This avoids the pressure falling to zero, which may occur in apparatus without such valve means at the end of each delivery cycle and which, in combination with the steepness of the falling pressure front, may cause gas to flow back from the combustion chamber into the injector nozzle, particularly in the presence of high combustion pressures. It is known that this phenomenon has a harmful effect both on the operational reliability of the injector and on the initial phase of introduction of fuel into the engine cylinder.

In injection apparatus of the type defined above, the valve means are conventionally located upstream of the outlet of the injection pump and are generally complicated, expensive and difficult to adjust.

The object of the present invention is to avoid these disadvantages and this object is achieved by virtue of the fact that the valve means include two calibrated, opposed non-return valves disposed in series downstream of the outlet of the injection pump, the valves cooperating with respective outlet orifices disposed in parallel, of which the one associated with the non-return valve located nearer the pump opens at one side towards the inlet of the injector and is closed at the other side by the respective non-return valve in the direction of flow of the injected fuel, and the one associated with the non-return valve located nearer the injector opens at one side towards the outlet of the injection pump and is closed on the other side by respective non-return valve in the direction opposite the flow of injected fuel.

The orifice associated with the non-return valve located nearer the injector normally has a section at least equal to and preferably substantially greater than that of the orifice associated with the non-return valve located nearer the injection pump.

The two non-return valves are conveniently inserted in a body fixed to or forming part of the injector.

The invention will now be described in detail with reference to the appended drawing, provided purely by way of non-limiting example, which illustrates a fuel injection device according to the invention schematically in partial longitudinal section.

The device illustrated in the drawing comprises essentially an injection pump 1 connected to an injector 2 by a delivery line 3. In the embodiment illustrated, the pump 1 is a multi-cylinder in-line pump of conventional type including, in known manner, a body 4 in which a piston 5 cooperating with a fuel supply aperture 6 is movable, and a relief valve 7.

The injector 2 is also of conventional type and includes, in known manner, a pintle nozzle, not illustrated.

A tubular body, indicated 8, has two end unions 9, 10 connected respectively to the delivery line 3 and to the injector 2. A valve unit 11 is inserted in the body 8 and includes two non-return valves 12, 13 disposed in series and opposed to each other. More particularly, the non-return valve 12 includes a ball obturator 14 housed in a chamber 11 coaxial with the body 8 and acted upon by a helical compression spring 16 reacting at one end against an abutment 17 to which the ball obturator 14 is coupled and at the other end against an apertured plug 18 screwed into a correspondingly-threaded part of the body 8 and by means of which it is possible to vary the load of the spring 16.

The non-return valve 13 includes a ball obturator 19 which is housed in a chamber 20 whose axis is at a slight angle to the axis of the body 8 and which is acted upon by a helical compression spring 21 reacting at one end against an abutment 22 to which the obturator 19 is coupled by form coupling and at the other end against an apertured plug 23. The plug 23 is threaded and screwed into a corresponding internal thread in the body 8 to allow variation of the load of the spring 21.

The chambers 15 and 20 of the two valves 12 and 13 are connected together by two passages 24, 25 disposed in parallel and coaxial with the respective chambers 15, 20. The passage 24 communicates with the union 10, and hence with the injector 2, through part of chamber 20 and, with part of the chamber 15, defines an annular valve seat with which the obturator 14 of the valve 12 cooperates.

The passage 25 communicates with the union 9, and hence with the delivery line 3, through part of the chamber 15 and, with part of the chamber 20, defines an annular valve seat with which the obturator 19 of the valve 13 cooperates.

It should be noted that the section of the passage 25 is at least equal to and preferably substantially greater than that of the passage 24.

It will be obvious from the foregoing description that the two non-return valves 12 and 13 are normally maintained in a closed condition by the action of their respective biassing springs 16 and 21 and have opposite directions of opening. In effect, the valve 13, that is the one disposed nearer the injector 2, tends to open in the direction of the flow of fuel from the pump 1 to the injector 2, while the valve 12, that is the one nearer the pump 1, tends to open in the opposite sense from the direction of the injected fuel.

In operation, during the initial fuel-delivery phase, the pressure rise created by the piston 7 of the pump 1 upon closure of the supply opening 6 causes the opening of the relief valve 7 and, once the pressure downstream of the valve unit 11 is reached, the subsequent opening of the valve 13 whose obturator 19 moves away from the passage 25 to compress the spring 21. In this and the immediately subsequent phase of the cycle of injection of fuel into the cylinder of the engine, the valve 12 is kept closed with the possibility of movement relative to the passage 24 as a result of only small, momentary, negative upstream-downstream pressure differences relative to the valve, due to the reciprocating movement of the pressure waves in the body 8, without however influencing the injection phase.

In practice, therefore, the fuel from the delivery line 3 flows to the injector 2 through the apertured plug 18, the chamber 15, the passage 25, the chamber 20, and the apertured plug 23.

At the end of the delivery phase, as a result of the opening of the aperture 6 of the injection pump 1, the relief valve 7 and the non-return valve 13 are closed due to the pressure jump upstream/downstream thereof. Initially the valve 13 closes more slowly than the valve 7 as a result of the relief stroke.

The valve 12, which, as stated, operates in the opposite sense from the valve 13, will be kept open until the pressure downstream of the injector 2 has reached that set by the spring 16 (normally between 50 and 80 bars according to the application) and will close below this pressure to keep a residual pressure downstream of the injector 2, the function of which is to prevent the initiation of re-entry of the gas from the combustion chamber into the nozzle of the injector 2, as a primary but not unique effect. Clearly, this residual pressure will be generated after the closure of the pintle of the nozzle (the end of injection into the engine cylinder).

In addition to this result, the injection device described above allows important positive side-effects to be obtained, such as:

greater hydraulic stability in terms of uniformity of the fuel injected at each cycle;

elimination of post-injection phenomena and erosion of the portion of the duct concerned with the residual pressure by cavitation;

greater control of the dynamic injection advance, particularly during idling.

These advantages are particularly appreciable in an application to direct-injection diesel engines, particularly supercharged engines with high maximum combustion pressures.

Naturally, the constructional details and forms of embodiment of the device may be varied widely with respect to that described and illustrated, without thereby departing from the scope of the present invention.

Thus, for example, although the body 8 containing the valve unit 11 has been illustrated in the example as a component in itself which is connected directly to the injector 2, it should be noted that this body 8 could be connected to any portion of the delivery line 3 between the pump 1 and the injector 2 or could be formed directly in the injector itself or on the pump.

The conformation of the obturators 14 and 19 of the two valves 12 and 13, as well as the means for adjusting the opening pressure of these valves, could also be formed in a different manner from that illustrated. In particular, the obturators 14 and 19 could be conical instead of spherical and the threaded adjusting plugs 18 and 23 could be replaced by simple calibrated washers.

We claim:

1. Fuel injection apparatus for diesel engines, comprising an injection pump, an injector nozzle, and a device including valve means which connects the pump to the nozzle and is intended to maintain a residual pressure of a predetermined magnitude between the valve means and the injector nozzle between each injection cycle and the next, wherein the valve means comprise a valve body having first and second opposed chambers connected in series between said pump and said nozzle by two parallel orifices, a non-return valve located in each chamber for controlling a respective orifice the orifice associated with the non-return valve located nearer the pump is open at one side in communication with the inlet of the injector and is closed at its other side by the obturator of the respective non-return valve in the direction of flow of the injected fuel, and the orifice associated with the non-return valve located nearer the injector is open on one side in communication with the outlet of the injection pump and is closed on its other side by the obturator of the respective non-return valve in the direction opposite the flow of injected fuel.

2. Apparatus according to claim 1, wherein the orifice associated with the non-return valve located nearer the injector has a section at least equal to that of the orifice associated with the non-return valve located nearer the injection pump.

3. Apparatus according to claim 1, wherein the orifice associated with the non-return valve nearer the injector has a section greater than that of the orifice associated with the non-return valve nearer the injection pump.

4. Apparatus according to claim 1, wherein said valve body which houses the two non-return valves is selected from a body fixed to the injector, a body forming part of the injector, and a body forming part of the pump.

5. Apparatus according to claim 1, wherein the non-return valves are selected from valves of the ball-obturator type and the conical-obturator type.

* * * * *